United States Patent [19]

Iyengar

[11] Patent Number: 4,582,568

[45] Date of Patent: Apr. 15, 1986

[54] APPARATUS FOR CONTROLLING THE CONSISTENCY OF A PULP SUSPENSION

[75] Inventor: Rangaswami S. Iyengar, Pittsfield, Mass.

[73] Assignee: Beloit Corporation, Beloit, Wis.

[21] Appl. No.: 532,357

[22] Filed: Sep. 15, 1983

[51] Int. Cl.[4] ..... D21C 9/18

[52] U.S. Cl. ..... 162/258; 100/117; 137/92; 162/232; 210/104; 210/251

[58] Field of Search ..... 100/111, 117, 45; 162/18, 56, 258, 49, 198, 232; 137/92, 4; 210/97, 104, 105, 251

[56] References Cited

U.S. PATENT DOCUMENTS

| | | | |
|---|---|---|---|
| 2,607,680 | 8/1952 | Weiss et al. | 162/18 |
| 2,862,813 | 12/1958 | Birdseye | 162/18 |
| 3,585,924 | 6/1971 | Nolan | 100/117 |
| 3,682,444 | 8/1972 | Reinhall | 162/56 |
| 3,811,993 | 5/1974 | Ghisoni | 162/56 |
| 3,943,033 | 3/1976 | Wallen | 162/18 |

*Primary Examiner*—Steve Alvo

*Attorney, Agent, or Firm*—Hill, Van Santen, Steadman & Simpson

[57] ABSTRACT

A method and apparatus for treating a pulp suspension in the manufacture of paper employing a controlled drainage thickener and a screw type pulp press. Pulp is fed into the thickener where the feed screw contained therein delivers it to a vertical discharge column. A screw type conveyor delivers the pulp suspension from the vertical discharge column into a vertical inlet column associated with a screw type pulp press. A sensing means is provided to measure the consistency of the pulp entering the press, and a sensing means provides a control signal which is arranged to modulate operation of a discharge valve on the thickener to keep the consistency of the pulp entering the screw type pulp press within a predetermined range.

3 Claims, 2 Drawing Figures

APPARATUS FOR CONTROLLING THE CONSISTENCY OF A PULP SUSPENSION

BACKGROUND OF THE INVENTION

1. Field of the Invention

This invention deals with a pulp treatment apparatus and method to effect automatic control of pulp consistency within a predetermined range by control of the effluent discharge of a controlled drainage thickener to thereby vary the consistency of a pulp suspension being fed from the thickener to a screw type pulp press.

2. Description of the Prior Art

Dewatering devices used in the paper industry generally are based on (1) drainage through a mat aided by a vacuum, (2) compression and shear, or (3) centrifugation. Thickening of suspensions can be grouped into several solid ranges, namely, 0.5 to 3%, 3 to 10%, and 10 to 40%. A Decker thickens from about 1% to about 10% and a continuous centrifuge thickens from about 4% to about 20%. The throughput and the efficiency of these devices are typically a function of the material's dewatering properties. All of these devices, however, have little or no control over the quantity of liquid expressed from them. Generally speaking, either consistency or level controls are utilized in an attempt to achieve a certain consistency range so that the consistency is appropriate for the most efficient operation of apparatus following the dewatering device.

A thickener is unlike a pulp press in that it acts more in the nature of a screen. Stock is introduced into the thickener by means of an inlet pipe under feed pressure. A pressure differential is produced across the screen by virtue of the feed pump and the back pressure from the effluent discharge. The magnitude of this pressure differential is controlled by a valve regulating the effluent flow rate. Pulp is forced against the screen and partially dewatered by virtue of the pressure differential. Periodically the pulp is wiped from the surface of the screen by the flights of a rotating screw. The clearance between the flight and the basket is typically about 0.030 inches. At lower rates, the screw also contributes to pulp flow. The flight to screen clearance is maintained within the smallest possible distance to insure sufficient wiping of the screen surface. The tight clearance is especially important with pulp in the operating consistency range of 2 to 12%.

A pulp press, on the other hand, dewaters stock by compacting or squeezing the pulp to force the water out. In a typical screw type press such as the Beloit-Jones Horizontal Pressmaster, the central shaft of the screw becomes larger in diameter from the inlet to the outlet ends and the pitch of the flights changes. The press has some back pressure on the inlet end to prevent slippage of the stock around the screw as it is being compacted to force the water out. The controlled back pressure usually takes the form of a column of stock above the inlet.

SUMMARY OF THE INVENTION

The present invention uses a combination of a controlled drainage thickener with a screw type pulp press with means being provided for automatically controlling the consistency of the stock being fed to the press to within a predetermined range. Heretofore, the inlet consistency to the screw press has generally been in the range of about 3 to 5% solids. At this range of solids, free water exists and the capacity of the unit is limited to the retention time required for removal of the free water before the material can be dewatered by means of compressive forces. As the consistency to the press increases, so that lower amounts of free water are available, the required retention time decreases. At a consistency range of about 10 to 12% with most furnishes, virtually no water is removed by free drainage alone. As the solids to the press increase from 4% to 10%, the throughput of the press at the same outlet consistency increases three-fold. Thus the combination of the thickener with the press provides a low-cost method for increasing the capacity of the system.

In some circumstances, a material in the press might no longer be conveyed. The material dewaters and due to a variety of reasons, slippage of the stock against the screen, flights and spindle may occur. Generally this causes increased torque and hence increased motor load. Heretofore, the solution has been to decrease the consistency in the pulp suspension entering the press. In the case of the present invention, however, there is provided a feedback loop where the press motor load controls the effluent valve on the thickener effluent, to prevent such a condition. As the effluent valve of the thickener is closed, the consistency to the press drops and the stock is once more conveyed. The benefits of the combination are those of increased capacity at low capital cost, good controllability, and minimal down time due to press plugging.

It is generally accepted that a screw type press operates most efficiently when the inlet consistency of the pulp is between 8% and 12%. This makes it ideally suited for use in conjunction with a controlled drainage thickener which typically produces consistencies in that range.

The present invention is directed primarily to the combination of a controlled drainage thickener and a press utilizing a control system which senses the input consistency to the press and through a control network modulates a flow control valve in the effluent discharge from the controlled drainage thickener to assure that the input consistency to the press remains between 8% and 12%.

The apparatus of the present invention may consist of a controlled drainage thickener which has a feed screw arranged for rotation within the thickener, and a discharge valve controlling the flow of effluent therefrom. A vertical discharge column receives this stock propelled by the feed screw. A screw type conveyor delivers pulp from the top of the vertical discharge column of the thickener to a vertical inlet column arranged to feed stock into the pulp press. The existence of the hydrostatic column provides a back pressure on the inlet end to prevent slippage of stock around the screw as the water is forced out by compaction. A sensing means is provided to measure the consistency of the pulp entering the press. This may take the form of a level sensor in the vertical inlet column or a torque indicator coupled to the motor driving the screw in the screw press. A signal thus derived which is proportional to the consistency of the pulp entering the inlet column is sent through control means which eventually modulates the operation of the effluent discharge valve on the thickener to maintain the consistency of the pulp within the predetermined range.

Expressed as a method, the present invention provides the steps of passing a pulp suspension through a controlled drainage thickener to produce a thickened pulp suspension and a liquid effluent, passing the thickened pulp suspension to a screw type pulp press, and maintaining the consistency of the pulp suspension entering the pulp press within a desired range by controlling the effluent discharge from the controlled drainage thickener.

BRIEF DESCRIPTION OF THE DRAWINGS

The invention is illustrated more completely in the accompanying sheets of drawings in which.

DESCRIPTION OF THE PREFERRED EMBODIMENTS

Figure 1:
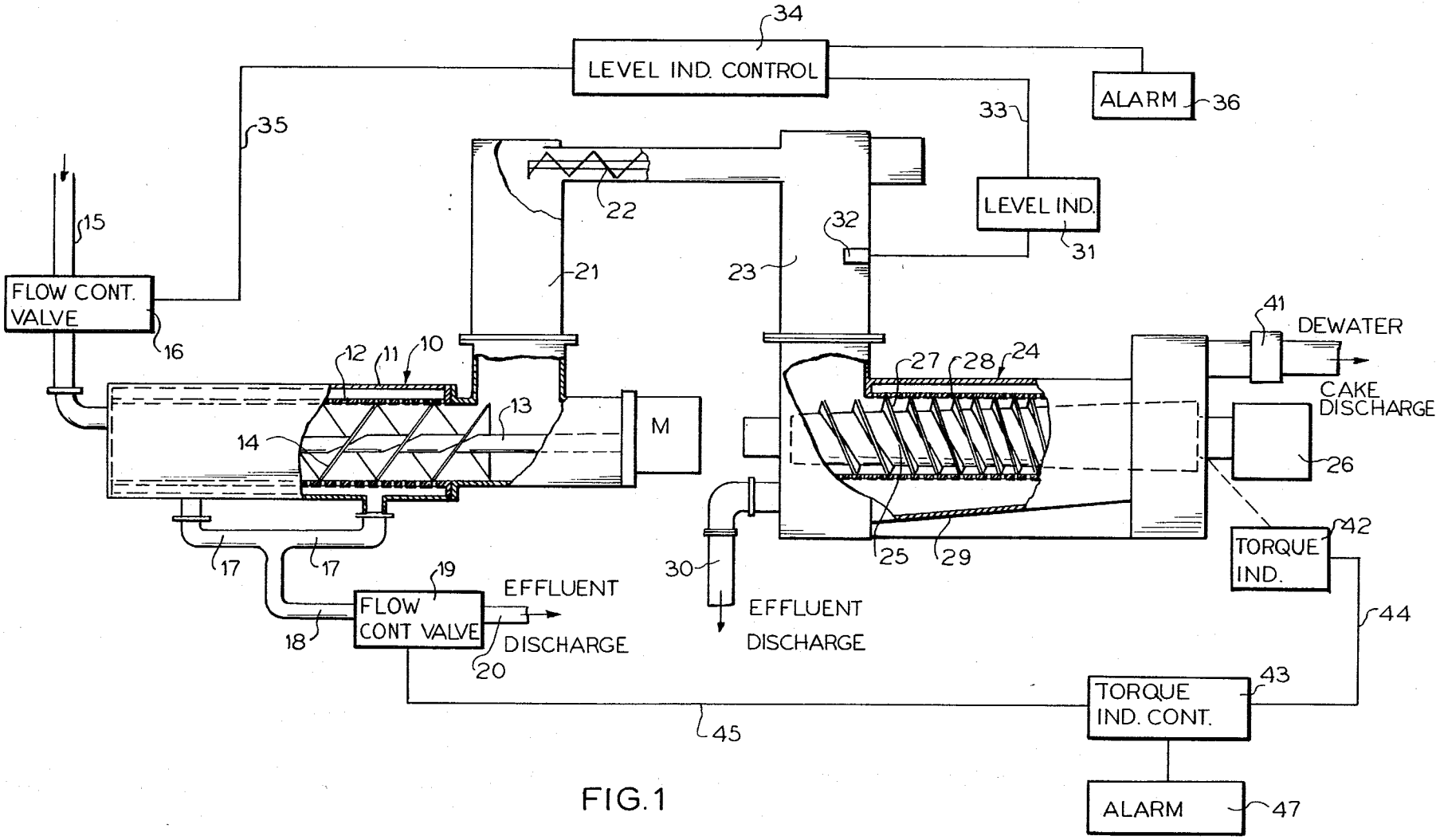
FIG. 1 is a partially schematic view, partly broken away, illustrating a pulp treating apparatus according to the present invention.

In FIG. 1, reference numeral 10 has been applied generally to a controlled drainage thickener including an outer housing 11, a screen 12 and a screw 13 on which flights 14 are arranged. The pressure differential across the screen 12 provides the driving movement. Depending upon the amount of fines in the furnish being supplied, an increase in the differential pressure increases the solids content of the thickened stock followed by a decrease in solids. This decrease in solids content is due to the fact that as higher pressure drops are applied, the thickener begins to function as a screen would. With this type of thickener there is control over the amount of liquid removed by virtue of mat thickness, frequency of mat removal, and pressure drop.

The clearance between the flights 14 and the screen 12 is maintained as small as possible to insure efficient wiping of the screen surface. The slight clearance is especially important with pulp in a consistency range of 2 to 12%.

The pulp suspension is received through an inlet pipe 15 and passes through a flow control valve 16 before being introduced into the thickener 10. The effluent from the thickener is directed to a plurality of discharge pipes 17 which feed a single discharge pipe 18.

The stock is introduced into the thickener from the inlet line 15 under feed pressure. The screw flights 14 serve to wipe the deposited mat away from the screen rather than compact the stock. The rate of flow of liquid through the screen 12 can be controlled by the back pressure on an effluent discharge line 18 which is controlled by a flow control valve 19. The effluent is discharged at a control rate through a discharge line 20.

A motor M is provided to drive the feed screw 13 at a predetermined constant rate.

A vertical discharge column 21 positioned at the discharge end of the feed screw 13 provides a hydrostatic head of pulp suspension. A screw conveyor 22 located near the top of the vertical discharge column 21 serves to scoop the pulp from the top of the column as it rises in the column. The screw conveyor 22 then conveys the pulp suspension to a vertical inlet column 23 associated with a screw type pulp press generally indicated at reference numeral 24 in the drawings. The vertical inlet column 23 acts as a standpipe to apply hydrostatic pressure on the inlet end of the screw type pulp press 24. The screw type pulp press 24 may be a commercially available press such as the Beloit-Jones Horizontal "Pressmaster". It includes a shaft 25 driven by a motor 26 and has flights 27 thereon, the central shaft 25 of the press being larger in diameter from the inlet end to the outlet end, and the pitch of the flights 27 changes.

The screw is contained within a screen 28. Rotation of the screw causes the flights to compact or squeeze the pulp against the screen 28 to force the water out. The water effluent is drained by means of a sloping base wall 29 and is ultimately discharged through a discharge fitting 30. The resulting pulp cake is discharged through a discharge line 41 at the outlet end.

The control system for the described apparatus includes a level indicator 31 located at the vertical inlet column 23 of the press and having a sensor element 32 measuring the level in the column 23. The indicator sends a signal through a control line 33 to a level indicator control 34. This control 34 is connected by a control line 35 to the flow control valve 16 at the inlet to the controlled drainage thickener 10 and controls the amount of stock suspension initially directed to the controlled drainage thickener 10. In the event of a malfunction indicating a level which is too high or too low in the column 23, an alarm 36 is actuated to alert the operator to modify the setting on the flow control valve 16.

As the consistency of the pulp suspension entering the press 24 through the column 23 increases, an additional amount of torque is required to drive the screw. The torque is sensed by means of a torque indicator 42 which feeds a signal to a torque indicator control 43 through a control line 44. The torque indicator control 43 sends a control signal through a control line 45 to the flow control valve 19 located in the effluent discharge line of the controlled drainage thickener 10. If the torque sensed by the indicator 42 is too low, indicating that the consistency going into the press 24 is too low, the flow in the flow control valve 19 of the effluent line 18 is increased to thereby increase the consistency in the discharge from the thickener 10. An alarm 47 is provided in conjunction with the torque indicator control 43 to sound an alarm if the torque becomes too high or too low.

Figure 2:
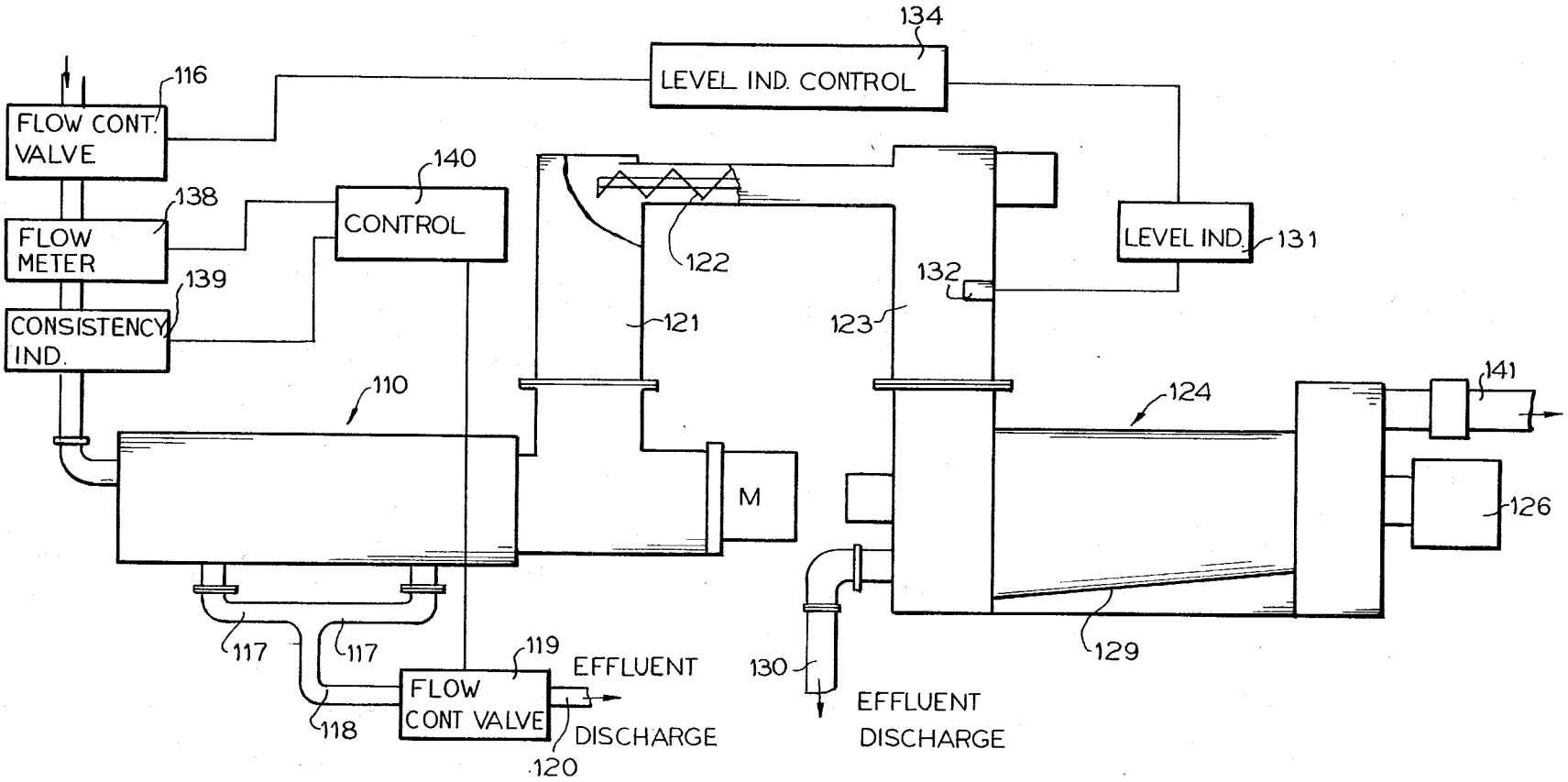
FIG. 2 is a somewhat schematic view of a modified form of apparatus which can be used to practice the present invention.

An alternative form of the invention is illustrated in FIG. 2. It includes a controlled drainage thickener 110 driven by a motor M, the thickener 110 being of the same type as the thickener 10 shown in FIG. 1. A pair of discharge pipes 117 feeds a common discharge pipe 118, and the effluent discharge is controlled by a flow control valve 119. Effluent discharge is provided by an effluent discharge line 120.

A vertical discharge column 121 provides a hydrostatic head against which the controlled drainage thickener 110 operates. As in the case of the previous embodiment, a screw type conveyor 122 is provided to scoop off the pulp as it rises in the column 121 and deliver it to a vertical inlet column 123 of a horizontal screw type pulp press 124. The effluent collects on an inclined bottom wall 129 and is discharged through an effluent discharge pipe 130. The cake is discharged through a discharge line 141. A motor 126 drives the screw contained in the screw type pulp press 124 at a constant velocity.

The modification of FIG. 2 differs from that shown in FIG. 1 in the control system employed. A level indicator 131 coupled to a sensor 132 provides signals to a level indicator control 134 indicating the height of the suspension in the column 123. A signal from the level indicator control 134 is received at the flow control valve 116 which controls the inlet to the controlled drainage thickener 110. In this form of the invention, however, the flow control valve is connected in series with a flow meter 138 which is coupled to a consistency indicator 139. Signals from the flow meter 138 and the consistency indicator 139 are jointly fed to a control 140 whose output signal is used to control the opening and closing of the flow control valve 119 in the effluent discharge line of the thickener 110.

The systems described modulate the flow control valve in the discharge of a controlled drainage thickener to assure that the input consistency to the pulp press is in the desired range of 8 and 12%. The increased level of consistency reduces the retention time required for removal of free water in the press. At a consistency range of about 10 to 12%, virtually no water is removed by free drainage alone. The increase in solids provided by the controlled drainage thickener thus improves the efficiency of the press considerably. As the solids to the press increase from 4 to 10%, the throughput of the press at the same outlet consistency, increases by a factor of 3.

It should be evident that various modifications can be made to the described embodiments without departing from the scope of the present invention.

I claim as my invention:

1. A pulp treatment apparatus comprising:

a controlled drainage thickener, a feed screw arranged for rotation within said thickener, a discharge valve controlling the flow of effluent from said thickener, a screw type pulp press, a vertical discharge column receiving a pulp suspension propelled upwardly therein by means of said feed screw, a vertical inlet column arranged to feed said pulp suspesion downwardly into said pulp press, a conveyor means delivering the pulp suspension from the top of said vertical discharge column to the top of said vertical inlet column, a level sensor positioned to sense the level of stock in said vertical inlet column, a flow control valve metering the stock introduced into said thickener, means for delivering signals from said level sensor into said flow control valve to control operation thereof, a flow meter arranged to measure the quantity of stock flow entering said thickener, a consistency indicator arranged to measure the consistency of stock entering said thickener, and means responsive to changes in said flow meter and said consistency indicator arranged to modulate operation of said discharge valve to maintain the consistency of the stock entering said thickener within a predetermined range.

2. A pulp treatment apparatus comprising:

a controlled drainage thickener, a feed screw arranged for rotation within said thickener, a discharge valve controlling the flow of effluent from said thickener, a screw type press, a vertical discharge column receiving a pulp suspension propelled upwardly therein by means of said feed screw, a vertical inlet column arranged to feed said pulp suspension downwardly into said pulp press, a conveyor means delivering the pulp suspension from the top of said vertical discharge column to the top of said vertical inlet column, a level sensor positioned to sense the level of stock in said vertical inlet column, a flow control valve arranged to control the flow of stock into said thickener, and means transmitting signals from said level sensor to said flow control valve to control the same.

3. A pulp treatment apparatus comprising:

a controlled drainage thickener having an inlet end and a discharge end, a feed screw rotatable within said thickener to propel pulp therealong, a discharge valve controlling the outflow of effluent at said discharge end, a vertical discharge column connected to the discharge end of said thickener, a screw type pulp press including a screw and a motor driving said screw, said screw type pulp press having an inlet end and an outlet end, a vertical inlet column connected to the inlet end of said pulp press, a conveyor means disposed between the upper end of said vertical discharge column and the upper end of said vertical inlet column to transfer pulp from said thickener to said screw type pulp press, torque sensing means coupled to said motor to sense changes in torque, and means connecting said torque sensing means to said discharge valve to modulate the output through said discharge valve upon variation of the consistency of stock entering said screen type pulp press.

* * * * *